US005476041A

United States Patent [19]

Czotscher

[11] Patent Number: 5,476,041

[45] Date of Patent: Dec. 19, 1995

[54] PRINTING PRESS HAVING A DEVICE FOR CONTROLLING THE AIR IN A SHEET FEEDER

[75] Inventor: Ernst Czotscher, NeckargemUnd, Germany

[73] Assignee: Heidelberger Druckmaschinen Aktiengesellschaft, Heidelberg, Germany

[21] Appl. No.: 288,471

[22] Filed: Aug. 10, 1994

[30] Foreign Application Priority Data

Aug. 11, 1993 [DE] Germany ..... 43 26 927.3

[51] Int. Cl.[6] ..... B41F 13/24

[52] U.S. Cl. ..... 101/232; 271/97; 271/98

[58] Field of Search ..... 101/232, 248, 101/216; 271/227, 236, 250, 11, 96, 97, 98, 20

[56] References Cited

U.S. PATENT DOCUMENTS

| | | | |
|---|---|---|---|
| 2,764,407 | 9/1956 | Alix . | |
| 3,916,790 | 11/1975 | Alix | 101/232 |
| 4,029,009 | 6/1977 | Kühn et al. | 101/232 |
| 4,414,882 | 11/1983 | Frei | 91/442 |
| 4,423,677 | 1/1984 | Fischer | 101/232 |
| 4,573,369 | 3/1986 | Horn | 74/110 |
| 4,702,469 | 10/1987 | Jeschke et al. | 271/227 |
| 4,790,244 | 12/1988 | Otfried et al. | 101/232 |
| 4,931,041 | 6/1990 | Faeser | 604/155 |
| 4,931,710 | 6/1990 | DeVara et al. | 318/663 |
| 5,034,004 | 7/1991 | Crankshaw | 604/154 |
| 5,058,876 | 10/1991 | Grossmann . | |
| 5,076,564 | 12/1991 | Marass | 271/11 |
| 5,092,578 | 3/1992 | Bergmeier et al. | 271/97 |
| 5,110,110 | 5/1992 | Wiaz et al. | 274/98 |
| 5,184,813 | 2/1993 | Schwitzky et al. | 271/98 |
| 5,213,036 | 5/1993 | Tokuno et al. | 101/232 |
| 5,215,014 | 6/1993 | Burger et al. | 101/248 |
| 5,290,023 | 1/1994 | Sasaki et al. | 271/20 |
| 5,322,012 | 6/1994 | Gartner et al. | 101/232 |

FOREIGN PATENT DOCUMENTS

| | | |
|---|---|---|
| 378038 | 7/1923 | Germany . |
| 933205 | 9/1955 | Germany . |
| 938428 | 2/1956 | Germany . |
| 3842390 | 6/1990 | Germany . |
| 3931995 | 4/1991 | Germany . |

*Primary Examiner*—Eugene H. Eickholt
*Attorney, Agent, or Firm*—Nils H. Ljungman & Associates

[57] ABSTRACT

A printing press for printing an image on sheets of printing stock can generally have a sheet feeder for separating and at least initiating start of transport of the separated sheet into the printing press. Such a sheet feeder can have a device for controlling feeder blowing air and feeder suction air, wherein the control device can have respective valves for accurately controlling the amount of blowing air and suction air. In addition, the amount of blowing air can be essentially exactly adjustable via the control console of the machine.

20 Claims, 4 Drawing Sheets

PRINTING PRESS HAVING A DEVICE FOR CONTROLLING THE AIR IN A SHEET FEEDER

BACKGROUND OF THE INVENTION

1. Field of the Invention

The invention generally relates to a printing machine, or press having a sheet feeder, and more specifically, to a device for controlling feeder blowing air and feeder suction air in a sheet feeder of a printing machine, or press. In general, printing presses are configured to handle large quantities of sheets of printing stock supplied in the form of a stack. For this purpose, sheet feeders which utilize air currents have been developed for repeatedly separating single sheets from a stack of sheets and initiating transport of the separated single sheets into the printing press. Such sheet feeders can utilize a blowing jet of air to fan the uppermost sheets of the stack, while a suction device can be provided to then suck the uppermost sheet thereto, and also to initiate movement of the sheet attached thereto into the printing press. The air suction and supply are generally controlled by a control device, which control device generally comprises respective valves for each of the feeder and blower air.

2. Background Information

A known embodiment of such a device is disclosed by German Laid Open Patent Application No. 39 31 995 A1, which corresponds to U.S. Pat. No. 5,068,876. This known embodiment provides two separate rotary valves for controlling the air, and each valve is individually controlled via an electromagnet. With this embodiment the rotary travel of an individual valve body may be manually adjusted via a rotary-travel limiter. Furthermore, fanning air supplied to the sheet feeder can also be manually adjusted via an adjusting screw so that the pressman does not have any exact adjusting values at hand, or in other words, so that the pressman does not have to remember the adjustment values that are input through the control.

OBJECT OF THE INVENTION

Proceeding from this known device, it is the object of the present invention to provide an air-controlling device for a sheet feeder of a printing press, which air-controlling device can preferably accurately control both blowing air and suction air, and by means of which air-controlling device, the blowing-air amount may be adjusted via the control console of the printing press.

SUMMARY OF THE INVENTION

According to the present invention this object can essentially be achieved by preferably providing both a first valve body for controlling the suction air and a second valve body for controlling the blowing air in a housing so as to be axially aligned. The two valve bodies are also preferably connected to each other in a manner so as to be axially firm, or moveable essentially simultaneously in an axial direction, while still being mutually turnable with respect to one another. One manner in which such a connection can be provided can preferably be by means of a fitting bolt. Further, an adjusting means can preferably be provided for axially adjusting both valve bodies to switch the suction air and the blowing air on and off. This adjusting means can preferably act on one of the two valve bodies, and there can preferably be provided a further drive device, which, via a pair of gears, can turn a valve body in order to control the blowing-air amount.

Such a solution essentially permits very short control periods, while enabling one adjusting means to control the suction air and the blowing air, respectively. Moreover, via the control console, the pressman may then also be able to accurately adjust the blowing-air amount for the respective sheet material which is being processed, while the blowing-air adjustment that is selected can also preferably be maintained when switching off end on the blowing air.

In an advantageous embodiment of the present invention, the valve bodies can also preferably be axially adjustable, with respect to the axial adjusting device, via an adjusting nut, to thereby allow for variations in-the size of a small opening through which the fanning air may escape when the valves are closed. Further, so that both valve bodies do not rotate when the blowing air is being adjusted, the valve body controlling the suction air can preferably be fixed against rotation by means of a pin.

A constructional modification of the above device can be provided by a device wherein the two valve bodies are firmly connected to each other, both axially and rotationally, while providing an adjusting means via which the two valve bodies can he turned in order to switch the suction air and the blowing air on and off, respectively. For this embodiment, there can preferably be provided a drive, via which the blowing-air amount can be controlled by axially displacing the valve bodies. According to this solution, given a similar setup of the valve bodies, essentially only the adjusting means is used to turn the valve bodies, and the drive serves to axially displace the valve bodies, and thus control the blowing-air amount. This exchange of adjusting means and drive means, in comparison with the first embodiment, also permits short control periods and an essentially exact adjustment of the amount off air required.

An advantageous embodiment of the two modifications described above, provides that as the adjusting means, there can preferably be provided a pneumatic cylinder for acting on the two valve bodies for controlling the suction air and the blowing air, respectively. In addition, the drive controlling the amount of blowing air can preferably be designed as a geared motor which, via a potentiometer, adjusts the second valve body. The use of a pneumatic cylinder permits very short control periods, and the use of a geared motor, in combination with a potentiometer for monitoring operation of the motor, ensures a very exact adjustment and allows for a display of the adjusted value at the control desk.

In summary, one aspect of the invention resides broadly in a printing press comprising: a frame; a plate cylinder rotatably mounted on the frame, the plate cylinder for positioning a printing plate thereon; dampening apparatus for applying dampening medium to the printing plate; an ink reservoir for holding a supply of ink; an inking mechanism for transferring the ink between the ink reservoir and the plate cylinder at least during operation of the printing press; the inking mechanism comprising a plurality of inking rollers, at least one ink fountain roller, and at least one ink transfer roller for transferring ink between the ink fountain roller and at least one of the plurality of inking rollers; sheet feeding apparatus for feeding sheets of printing stock into the printing press from a stack of printing stock, the stack having a top for supplying sheets therefrom; a rubber blanket cylinder having a rubber blanket disposed thereabout for receiving an ink impression from the plate cylinder; a sheet drum for receiving sheets being fed for printing the ink impression of the rubber blanket onto the sheets;

sheet delivery apparatus for receiving printed sheets and stacking the printed sheets; the sheet feeding apparatus comprising: apparatus for providing input air to an area adjacent the stack of printing stock; apparatus for removal of exhaust air from an area adjacent the stack of printing stock; apparatus for controlling air flow through the apparatus for providing input air and the apparatus for removal of exhaust air; the apparatus for controlling comprising valve apparatus; the valve apparatus comprising: a first valve portion for controlling flow of air through the apparatus for providing input air, the first valve portion having at least an open configuration for passage of air therethrough and a closed configuration for blocking passage of air therethrough; a second valve portion for controlling flow of air through the apparatus for removal of exhaust air, the second valve portion having at least an open configuration for passage of air therethrough and a closed configuration for blocking passage of air therethrough; at least one solid element connecting at least a portion of i the first valve portion to at least a portion of the second valve portion for substantially simultaneously moving both of the at least a portion of the first valve portion and the at least a portion of the second valve portion between at least the open configuration and the closed configuration; and single operating apparatus for operating all of the at least a portion of the first valve portion, the at least a portion of the second valve portion and the at least one solid element substantially simultaneously.

Another aspect of the invention resides broadly in a device for controlling air flow in a sheet feeder in a printing press, the sheet feeder having apparatus for providing input air thereinto and apparatus for removal of exhaust air therefrom, the device for controlling comprising: valve apparatus for controlling air flow through the apparatus for providing input air and the apparatus for removal of exhaust air; the valve apparatus comprising: a first valve portion for controlling flow of air through the apparatus for providing input air, the first valve portion having at least an open configuration for passage of air therethrough and a closed configuration for blocking passage of air therethrough; a second valve portion for controlling flow of air through the apparatus for removal of exhaust air, the second valve portion having at least an open configuration for passage of air therethrough and a closed configuration for blocking passage of air therethrough; at least one solid element connecting at least a portion of the first valve portion to at least a portion of the second valve portion for substantially simultaneously moving both of the at least a portion of the first valve portion and the at least a portion of the second valve portion between at least the open configuration and the closed configuration; and single operating apparatus for operating all of the at least a portion of the first valve portion, the at least a portion of the second valve portion and the at least one solid element Substantially simultaneously.

BRIEF DESCRIPTION OF THE DRAWINGS

Specimen embodiments of a control device in accordance with the present invention are schematically illustrated in the accompanying drawings, in which.

DESCRIPTION OF THE PREFERRED EMBODIMENT

Figure 1:
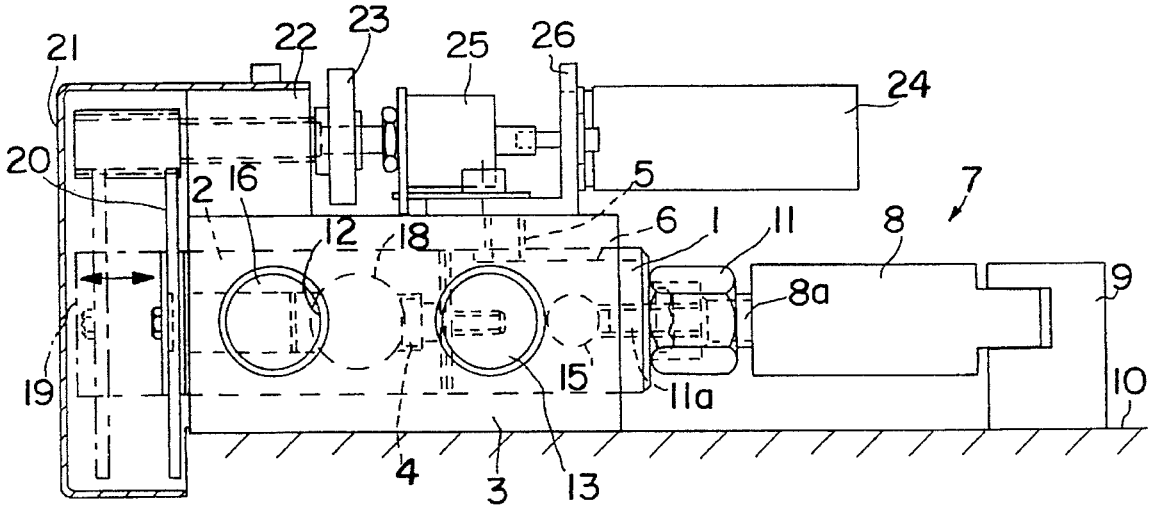
FIG. 1 shows a side elevational view of a first embodiment of an air-controlling device in an off position.
Figure 1A:
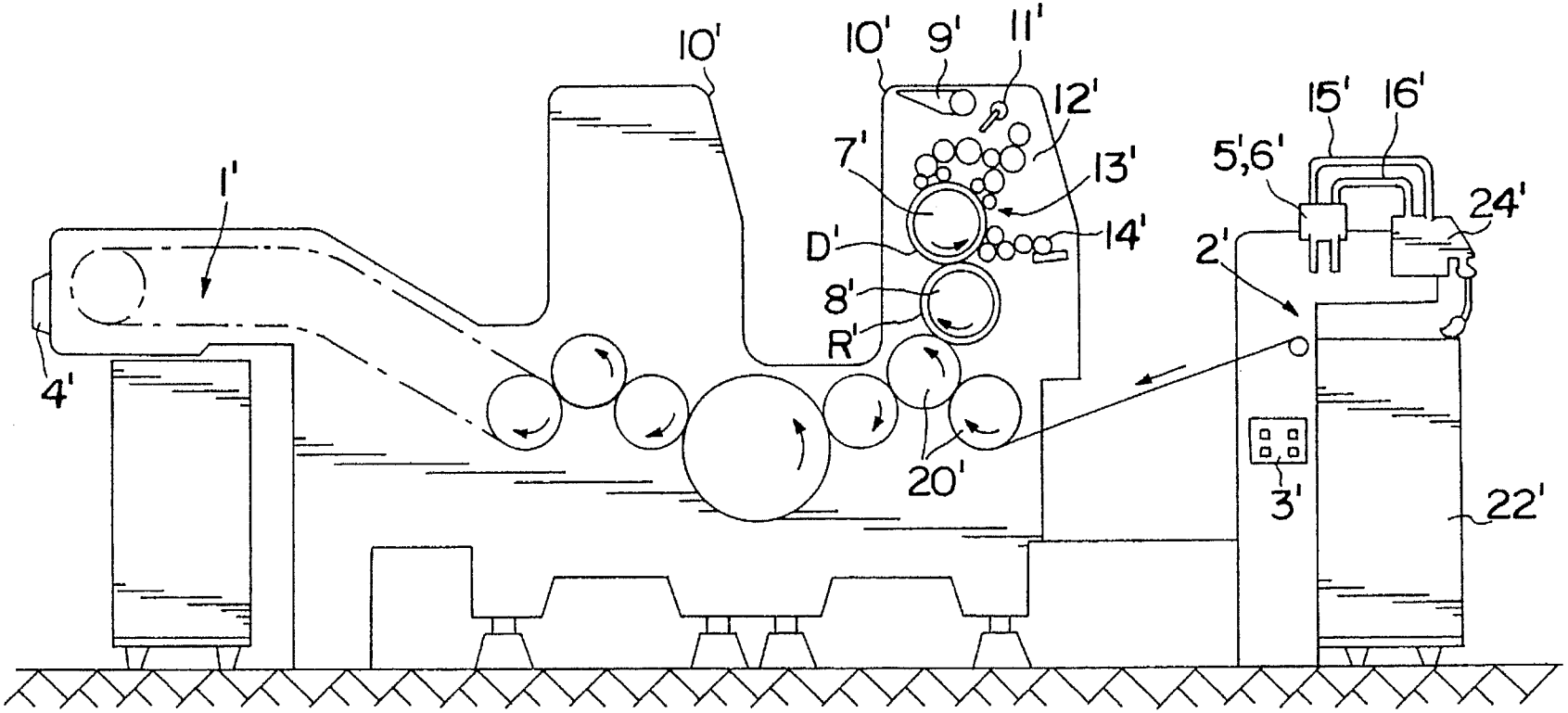
FIG. 1*a* shows a side view of a printing press incorporating a device for controlling feeder blowing and suction air in accordance with the present invention.

FIG. 1*a* depicts a printing machine, or printing press, having a number of rotary printing stands 10', with a sheet delivery 1' and a sheet feeder 2', which sheet feeder 2' can employ an air control device 5', 6' in accordance with the present invention, and described in further detail herebelow. In addition, a rotary print stand 10' can also generally include: an ink supply source 9' for containing a supply of ink, a plate cylinder 7' for having mounted thereon a printing plate D'; an inking unit 12' which includes ink applicator rollers 13' for applying ink to the printing press; a vibrator roller 11' for receiving ink from the ink supply 9' and transferring the ink to the inking unit 12', a damping, or wetting unit 14' for transferring a damping agent to the printing plate D'; a blanket cylinder 8' carrying a rubber blanket R' for receiving an ink impression from the plate cylinder 7', and sheet drums 20' for carrying a sheet of printing stock to the rubber blanket cylinder 8' for transfer of the ink from the rubber blanket cylinder 8' to the sheet of printing stock. Such a printing press can also have other accessory units, such as washing units, drive units, etc. which are well known and are not shown in the drawings.

The sheet feeder 2' can preferably have a stack of sheets of printing stock 22' and an air blower and suction device 5', 6' 15', 16' and 24', for lifting and transferring single sheets into the printing press. Such an air device can generally have two valve units 5', 6' with one Valve unit corresponding to each of a suction air passage 15' and a blower passage 16'. The valves 5' and 6' can preferably be controlled from an operator control panel 3'. Besides being operable via the operator controls 3' at the sheet feeder 2', the sheet feeder 2' may also be operated from a control console 4' located at the delivery pile 1'.

It should be understood that the components as discussed above with relation to FIG. 1*a*, may, if appropriate, essentially be considered to be interchangeable with similar components discussed herebelow with relation to FIGS. 1–5.

Figure 2:
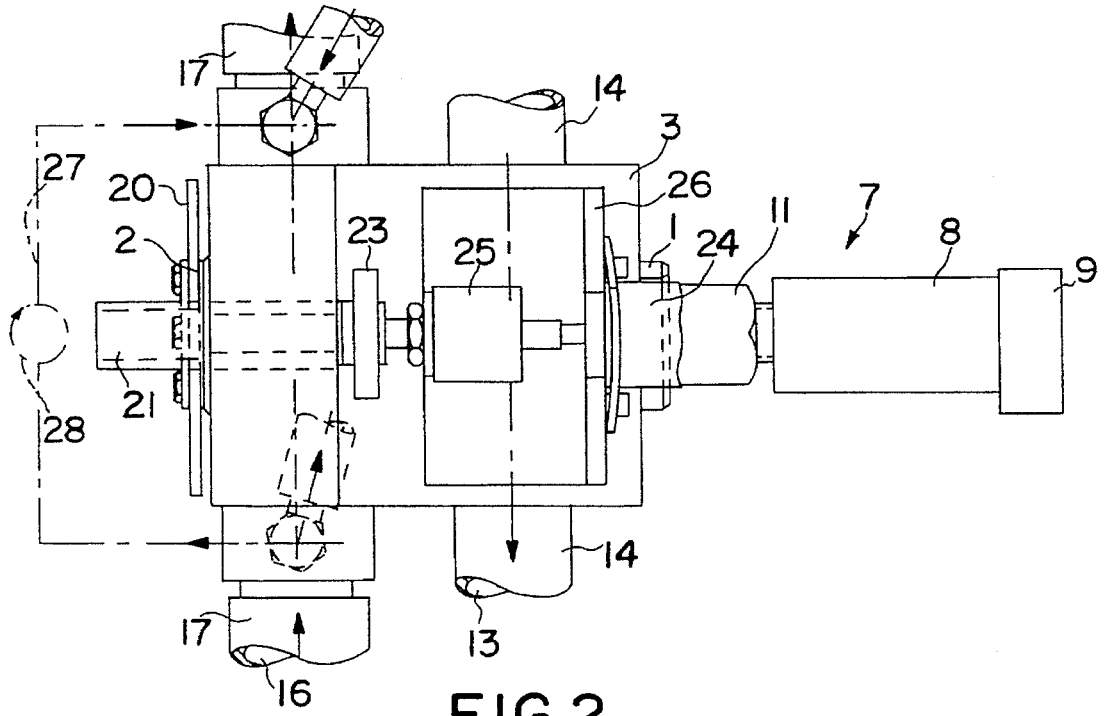
FIG. 2 shows a plan view of the device shown in FIG. 1.
Figure 3:
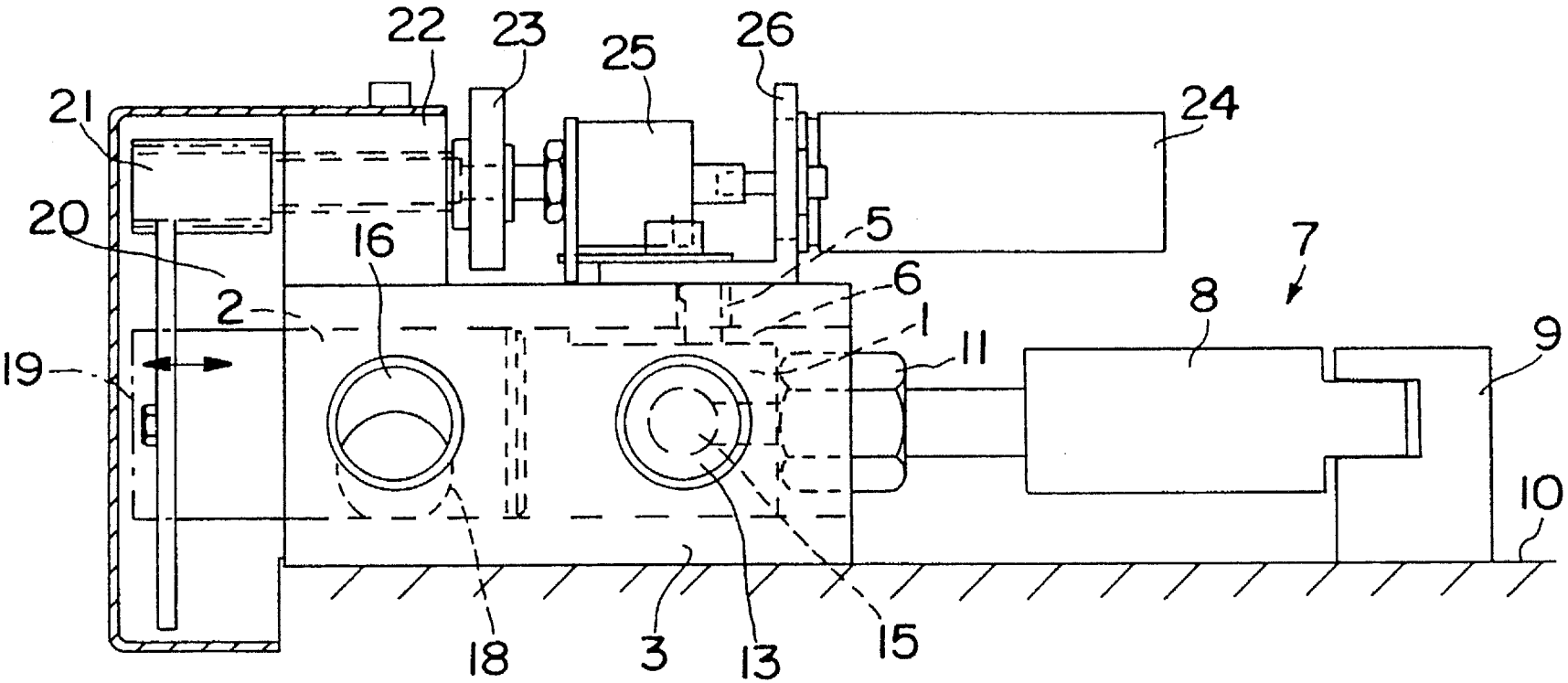
FIG. 3 shows a side elevational view of the valve of FIG. 1, but in en on position.

As depicted in FIGS. 1–3, a first valve body 1, of a valve unit such as unit 5', 6' as discussed previously in FIG. 1*a*, can preferably be provided in a housing 3 for controlling the suction air to a sheet feeder, and a second valve body 2 can preferably be provided for controlling the blowing air. In the depicted embodiment of FIG. 1, the valve bodies 1 and 2 are shown in an off position, and are arranged so as to be displaceable to the left to move the valve bodies 1 and 2 into a corresponding open position for flow of air therethrough. FIG. 3 depicts one possible configuration of the valve bodies 1 and 2 in a corresponding on position.

Both valve bodies 1, 2 are preferably connected to each other in an axially firm and mutually turnable manner. One type of connection devise which could be used is a fitting bolt 4, which enables the valve body 2, controlling the blowing air, to be turned with respect to the valve body 1, while also enabling both valve bodies to be displaced axially substantially simultaneously. In this embodiment, the valve body 1 can preferably be fixed against rotation in the housing 3 by means of a pin 5 engaging in a longitudinal groove 6 formed in the valve body 1. Alternatively, a pin could extend from valve body 1 to engage a slot within the housing 3. Further, other means of holding the valve body i stationary could also conceivably be used, such as a rigid connection, to an adjusting device 7.

In the specimen embodiment shown in FIG. 1 an adjusting device 7 acts on the first valve body 1, and therefore, in essence, acts on both bodies 1 and 2 because of the axial connection 4 therebetween. The adjusting device 7 can preferably be designed as a pneumatic cylinder 8 which, via a supporting bearing 9, can be attached to a wall 10 or any surface adjacent the valve device. Again, FIG. 1 shows the cylinder 8 retracted so that the valve bodies 1 and 2 are in an off, or substantially closed position. In this closed position, by means of an adjusting nut 11, the two valve bodies 1, 2 can be axially adjusted, if necessary, so that a small opening 12 can exist for the escape of fanning air. By means of such an adjustment, the size of the opening 12 can also preferably be adjusted very accurately for different paper thicknesses, etc. to allow more or less fanning air to escape therethrough. In at least one embodiment of the present invention, this adjusting nut 11 can preferably be axially fixed to a piston rod 8*a*, such that rotation thereof will draw a threaded rod 11*a* thereinto or push the threaded rod 11*a* away therefrom upon rotation of the nut 11, thereby axially displacing the valve bodies 1 and 2.

FIG. 1 shows the position in which the valve bodies 1, 2 are switched off so that the piston rod 8*a* of the pneumatic cylinder 8 is moved to the right into its end position. In so doing, an opening 13 of a suction-air line 14, can generally be closed as the suction-air opening 15, formed in the valve body 1, is displaced to the right and thus covered by the housing 3. The opening 16 of the blowing-air line 17 can preferably be offset with respect to the blowing-air opening 18 formed in the valve body 2 such that there remains a small opening 12 through which the fanning air may escape. The position in which the valves are open is the position in which both valve bodies 1, 2 are displaced to the left according to FIG. 1, as indicated by a dash-dotted line 19 in FIG. 1, and as is also depicted by FIG. 3.

In a sheet feeder device, it is generally desirable that the blowing and suction be provided by a single blower or fan unit, such as might be indicated as 24' in FIG. 1*a*. In other words, the air sucked out of the feeder is also the air blown back into the feeder. By providing such a valve unit wherein the blowing and suction air lines can be turned on and off substantially simultaneously using a single operational component, in accordance with the present invention, there would essentially be minimal concern about jamming of single independently operating valves for each of the blowing and suction lines, as have been used in known valve devices. Thus, both lines will either be open, or else both will be closed. On the other hand, in known devices using two separately operating valves, one valve may open when the other remains stuck shut, and there could then possibly be no suction air available while the blowing line is operating, or, alternatively, the air which is auctioned out may not be able to pass through a blocked blowing line.

In addition to the axial displacement provided by the adjusting device 7, as discussed above, an additional operating device can preferably be provided for rotating the valve body 2 with respect to the valve body 1. For this purpose, a spur gear 20 can preferably be provided for engaging in a broader spur gear 21, fastened to the front end of the valve body 2 for controlling the blowing air. The width of the spur gear 21 can preferably be designed such that the meshing of the gears is not interrupted over the axial displacement distance of the valve bodies 1, 2. The spur gear 21 can preferably be turnably mounted in a bearing body 22 and can be manually turned via a handwheel 23. Furthermore, there can also preferably be a geared motor 24 which controls the blowing-air amount and which, vie a potentiometer 25, can drive the spur gear 21. The geared motor 24 and the potentiometer 25 can preferably be fastened to the housing 3 via an angular-shaped body 26. By turning the valve body 2 via the geared motor 24 the alignment and covering of the blowing-air opening 18, and the opening 16 of the blowing-air line 17 may be varied such that a varying amount of blowing air may escape through the valve. This makes it possible to control the blowing air as a function of speed, for example, or to vary the blowing air according to the paper weight. FIG. 3 also essentially depicts an offset between the blowing air opening 18 and the opening 16, which was provided by relatively rotating the valve body 2 with respect to the valve body 1.

It should generally be understood that other types of drive systems could also possibly be used for relatively rotating the valve bodies. Such systems might include a transmission unit, such as a chain drive, or belt drive, and could even include a motor directly mounted to the end of the valve body 2, which motor could also be mounted to a holding device to be non-rotational with respect to the valve body 2. Substitution of any of the drive devices, and adjustment devices as discussed above would typically be well within the skill of the artisan, as a wide variety of drive devices are generally well known.

An alternative variant on the above embodiment of the present invention could preferably utilize, as an adjusting device 7, an electromagnet instead of a pneumatic cylinder 8. Such an electromagnet can preferably be configured to axially displace the valve bodies 1, 2, and the configuration and operation of such an electromagnet are generally well known and therefore not discussed in any:further detail herein.

Figure 4:
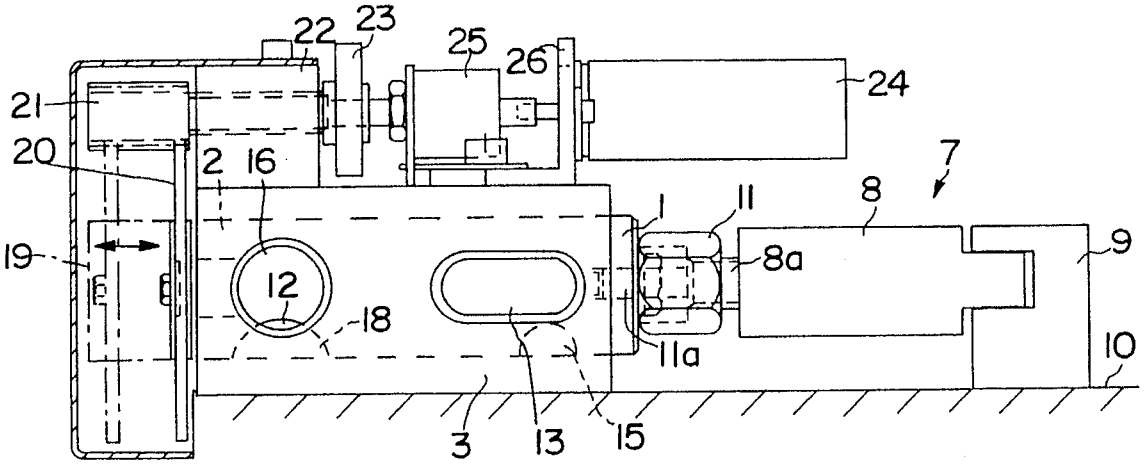
FIG. 4 shows a side elevational view of a second embodiment of an air-controlling device in an off position.
Figure 5:
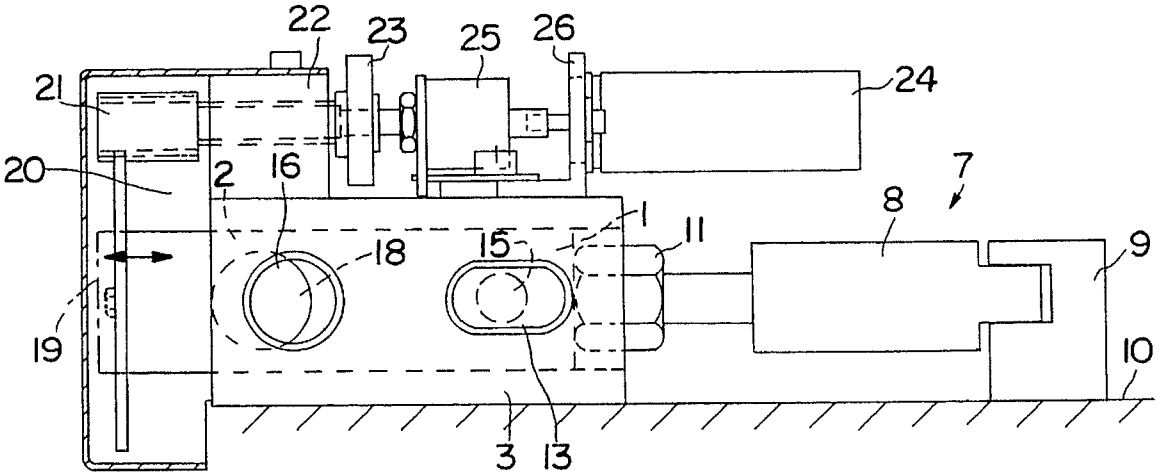
FIG. 5 shows a side elevational view of the valve of FIG. 4, but in an on position.

The set task may also be accomplished through another inventive construction of the valve, such as could be represented by the embodiment shown in FIGS. 4 and 5. With this specimen embodiment, the blowing air can preferably be switched on and off by turning the valve bodies 1 and 2 instead of axially displacing the valve bodies 1 and 2 as was discussed hereabove. In addition, the blowing air can then preferably be regulated by axially displacing the valve bodies 1 and 2 via an axial displacement device 7, such as, a motor-driven threaded spindle, or possibly even the pneumatic cylinder as discussed above. In this manner, an adjustable opening between blowing air opening 18 and opening 16 could still be achieved.

According to this alternative embodiment, the axial position of the valve bodies 1 and 2 can preferably remain unchanged when switching on and off the blowing air. This can essentially be accomplished by simply radially turning the valve bodies 1 and 2 so that the corresponding openings are no longer essentially aligned. In the position in which the blowing air is switched off, a small opening 12, for providing fanning air for fanning the sheets, can still be achieved in that the radial adjustment can provide such an opening. With this design the blowing-air valve may be actuated together with the suction-air valve, provided the valve bodies 1, 2 are firmly connected to each other. Alternatively, as shown in FIGS. 4 and 5, the valve bodies 1 and 2 could preferably be formed of a single body piece having two openings, or passages disposed substantially diametrically therethrough.

However, the ability for the suction opening 15 to remain unchanged when regulating the blowing air, that is, after radially adjusting the suction opening to the on position, still has to essentially be guaranteed when an axial adjustment of the blowing air is performed. For this purpose the suction-air opening 13, formed in the housing 3, can preferably be designed as an oblong hole, or slot, in the axial direction of the housing 3, so that, in the switched-on position, the bore 15 provided in the valve body 1 is still aligned with the opening 13. This oblong opening 13 should therefore preferably be of such a length that the suction-air opening remains open in view of any axial blowing-air adjustment.

As an alternative to providing a small opening 12, as shown in FIGS. 1 and 4, in an alternative embodiment of the present invention, it is also conceivable to supply the fanning blowing air through a bypass 27 (indicated by a broken line in FIG. 2), whereby the bypass may comprise a valve 28 for adjusting the amount of air which is able to pass therethrough.

One feature of the invention resides broadly in a device for controlling feeder air and feeder suction air in a sheet feeder of a printing machine comprising respective valves, characterized in that a first valve body 1 for controlling suction air and a second valve body 2 for controlling blowing air are disposed in a housing so as to be axially aligned, that the two valve bodies 1, 2 are connected to each other by a fitting bolt 4 in an axially firm and mutually turnable manner, that an adjusting means 7, via which the two valve bodies are axially adjustable for switching on/off the suction air and blowing air, respectively, acts on a valve body 1, and that there is provided a drive 24 which, via a pair of gearwheels 20, 21, turns the valve body 2 for controlling the amount of blowing air.

Another feature of the invention resides broadly in the device characterized in that, via an adjusting nut 11, the valve bodies 1, 2 are axially adjustable in order to vary the small opening 12 for the fanning blowing air, and that the valve body 1 controlling the suction air is fixed against rotation by means of a pin 5.

Yet another feature of the invention resides broadly in the device characterized in that the two valve bodies 1, 2 are firmly connected to each other, that there is provided an adjusting means 7 via which the two valve bodies 1, 2 are turnable in order to switch on/off the suction air and the blowing air, respectively, and that there is provided a drive 24 controlling the amount of blowing air by axially displacing the valve bodies 1, 2.

Still another feature of the invention resides broadly in the device characterized in that as an adjusting means 7 there is provided a pneumatic cylinder 8 acting on the two valve bodies 1, 2 for controlling the blowing air and the suction air, respectively, and that the drive controlling the amount of blowing air is designed as a geared motor 24 which, via a potentiometer 25, adjusts the second valve body 2.

Some examples of drive devices and potentiometers which could be used in conjunction with the present invention are disclosed by the following U.S. Pat. No. 5,215,014 to Burger and Mamberer, entitled "Positioning System for Rotary Folding Jaw Cylinder Adjustment Elements in a Rotary Printing Machine"; U.S. Pat. No. 5,034,004 to Crankshaw, entitled "Infusion Pump and Drive Systems Therefor"; U.S. Pat. No. 4,932,831 to White et al., entitled "All Terain Mobile Robot"; U.S. Pat. No. 4,931,041 to Feeset, entitled "Infusion Syringe Pump"; and U.S. Pat. No. 4,931,710 to DeVara and Kenny, entitled "Servoactuator with Feedback and Method of Calibrating".

Some example of pneumatic cylinders which could be used in conjunction with the present invention are disclosed by the following U.S. Pat. No. 4,573,369 to Horn, entitled "Linear Drive"; and U.S. Pat. No. 4,414,882 to Frei, entitled "Pneumatic Drive for Switching Elements and Control Elements".

Some examples of printing presses with sheet feeders that operate with blowing and suction air, in which the present invention could be used, and/or which provide additional components and features of printing presses and sheet feeders which could be used in conjunction with the present invention, are provided by the following U.S. Pat. No. 5,290,023 to Seaski and Honkawe, entitled "Sheet Feeder for Sheet-Fed Press"; U.S. Pat. No. 5,184,813 to Schwitmky and Stiel, entitled "Separating Jet Blast Air Control Assembly"; U.S. Pat. No. 5,076,564 to Marass, entitled "Sheet Feeder"; U.S. Pat. No. 5,110,110 to Wirz and Bergmeier, entitled "Loosening Blowers for Sheet Feeders of Sheet-Fed Rotary Printing Presses"; U.S. Pat. No. 5,092,578 to Bergmeier and Zeltner, entitled "Sheet Feeder in a Sheet-Processing Machine"; and U.S. Pat. No. 4,702,469 to Jeschke and Pollich, entitled "Apparatus and Method for Aligning Sheets".

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign patent publication applications, namely, Federal Republic of Germany Patent Application No. P 43 26 927.3, filed on Aug. 11, 1993, having inventor Ernst Czotscher, and DE-OS P 43 26 927.3 and DE-PS P 43 26 927.3, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

What is claimed is:

1. A printing press comprising:

a frame;

a plate cylinder rotatably mounted on said frame, said plate cylinder for positioning a printing plate thereon;

dampening means for applying dampening medium to said printing plate;

an ink reservoir for holding a supply of ink;

an inking mechanism for transferring the ink between said ink reservoir and said plate cylinder at least during operation of said printing press;

said inking mechanism comprising a plurality of inking rollers, at least one ink fountain roller, and at least one ink transfer roller for transferring ink between said ink fountain roller and at least one of said plurality of inking rollers;

sheet feeding means for feeding sheets of printing stock into the printing press from a stack of printing stock, the stack having a top for supplying sheets therefrom;

a rubber blanket cylinder i having a rubber blanket disposed thereabout for receiving an ink impression from the plate cylinder;

a sheet drum for receiving sheets being fed for printing the ink impression of the rubber blanket onto the sheets;

sheet delivery apparatus for receiving printed sheets and stacking the printed sheets;

said sheet feeding means comprising:

means for providing input air to an area adjacent the stack of printing stock, said means for providing input air comprising a first air passage for conducting input air to the area adjacent the stack of printing stock;

means for removal of exhaust air from an area adjacent the stack of printing stock, said means for removal of exhaust air comprising a second air passage for conducting exhaust air away from the area adjacent the stack of printing stock;

said first air passage being separate from and isolated from said second air passage;

means for controlling air flow through said means for providing input air and said means for removal of exhaust air;

said means for controlling comprising valve means;

said valve means comprising:

a first valve portion for controlling flow of air through said first air passage, said first valve portion having at least an open configuration for passage of air therethrough and a closed configuration for blocking passage of air therethrough;

a second valve portion for controlling flow of air through said second air passage, said second valve portion having at least an open configuration for passage of air therethrough and a closed configuration for blocking passage of air therethrough;

at least one solid element connecting at least a portion of said first valve portion to at least a portion of said second valve portion, said at least a portion of said first valve portion and said at least a portion of said second valve portion being connected by said at least one solid element for substantially simultaneous movement of both of said at least a portion of said first valve portion and said at least a portion of said second valve portion from at least the closed configuration to the open configuration for substantially simultaneous providing of air to the area adjacent the stack and removing of air from the area adjacent the stack, and for substantially simultaneously moving both of said at least a portion of said first valve portion and said at least a portion of said second valve portion from at least the open configuration to the closed configuration to substantially simultaneously stop providing of air to the area adjacent the stack and removing of air from the area adjacent the stack; and single operating means for operating all of: said at least a portion of said first valve portion, said at least a portion of said second valve portion, and said at least one solid element, substantially simultaneously.

2. The printing press according to claim 1, wherein said valve means comprises:

a valve housing, said valve housing having first and second openings for defining at least a portion of the first air passage of said means for providing input air, and third and fourth openings for defining a second air passage of said means for removal of exhaust air;

a valve body for being disposed in said valve housing, said valve body comprising a first connecting passage for connecting said first and second openings, and a second connecting passage for connecting said third and fourth openings;

said first valve portion comprises said first and second openings and said first connecting passage;

said second valve portion comprises said third and fourth openings and said second connecting passage;

said single operating means being for moving said valve body within said valve housing to:

move said first connecting passage into at least partial alignment with said first and second openings to at least partially open said first air passage, and to substantially simultaneously move said second connecting passage into at least partial alignment with said third and fourth openings to at least partially open said second air passage; and move said first connecting passage substantially out of alignment with said first and second openings to at least substantially close said first air passage, and to substantially simultaneously move said second connecting passage substantially out of alignment with said third and fourth openings to at least substantially close said second air passage.

3. The printing press according to claim 2, wherein:

said valve housing has an;exterior and defines a longitudinal axis;

said valve housing comprises a bore along said longitudinal axis;

said first, second, third and fourth openings being disposed through said housing from said exterior to said bore;

said valve body comprises a cylindrical body for being movably disposed within said bore;

said first and second connecting passages respectively comprise first and second bores within said cylindrical body; and said means for operating comprises means for moving said cylindrical body within said bore to at least partially open and at least substantially close said first and second air passages.

4. The printing press according to claim 3, wherein:

said means for operating comprises first means for operating, and said first means for operating comprises one of:

means for rotating said cylindrical body within said bore; and means for axially displacing said cylindrical body along the longitudinal axis of said bore; and said valve means additionally comprises means for varying an amount of air flowing through said first air passage substantially independently of the amount of air flowing through said second air passage.

5. The printing press according to claim 4, wherein:

said cylindrical body defines a longitudinal axis, and said cylindrical body comprises:

a first body portion comprising said first connecting passage;

a second body portion comprising said second connecting passage, said first body portion being axially disposed with respect to said second body portion along said longitudinal axis of said cylindrical body;

said at least one solid element comprises means for rotatably connecting said first body portion to said second body portion for relative rotational movement between said first body portion and said second body portion;

said first means for operating comprises means for axially displacing said cylindrical body within said bore;

said valve means further comprises means for inhibiting rotation of said second body portion; and said means for varying an amount of air flowing through said first air passage substantially independently of air flowing through said second air passage comprises second means for operating, said second means for operating comprises means for rotating said first body portion relative to said second body portion to move said first connecting passage relative to said first and second openings to vary an opening amount of said first air passage.

6. The printing press according to claim 5, wherein:

said valve means further comprise means for axially positioning said cylindrical body with respect to said first means for operating to partially open said first air passage with said second air passage closed;

said first and second connecting passages are each disposed substantially diametrically through said cylindrical body;

said first and second openings are disposed substantially diametrically with respect to one another on said housing;

said third and fourth openings are disposed substantially diametrically with respect to one another on said housing;

said means for rotatably connecting comprises bolt means extending from one of said first body portion and said second body portion and a threaded opening on the other of said first body portion and said second body portion to receive said bolt means therein;

said means for inhibiting rotation comprises pin means extending from one of said housing and said second body portion and slot means in the other of said housing and said second body portion for receiving said pin means therein;

said first means for operating comprises a pneumatic cylinder; and said second means for operating comprises a motor, said motor having a rotatable shaft, and said rotatable shaft additionally comprising a transmission for transmitting rotational movement to said first body portion.

7. The printing press according to claim 6, wherein:

said pneumatic cylinder comprises a piston rod extending therefrom, said pneumatic cylinder and said piston rod defining a longitudinal axis;

said longitudinal axis of said pneumatic cylinder being disposed in alignment with said longitudinal axis of said cylindrical body;

said piston rod having a first end disposed away from said pneumatic cylinder;

said second body portion comprises a threaded member extending therefrom towards said pneumatic cylinder;

said first end of said piston rod comprises a threaded nut for engaging said threaded member of said second body portion for moving said second body portion during moving of said pneumatic cylinder;

said means for axially positioning said cylindrical body with respect to said first means for operating comprises said threaded nut and said threaded member, whereby rotation of said threaded nut axially displaces said threaded member;

said second means for operating further comprises a potentiometer driven by said rotatable shaft of said motor for measuring rotational movement/of said motor;

said rotatable shaft further comprising a handwheel for manually turning said rotatable shaft;

said transmission comprising a first gear disposed on said rotatable shaft, and a second gear disposed on said first body portion and meshing with said first gear;

said second gear being non-rotatably connected to said first body portion for movement of said first body portion with movement of said second gear; and said means for inputting air additionally comprises an air bypass for bypassing air around said valve means when said first air passage is closed; and said air bypass comprises an additional valve means for adjusting an amount of air bypassing said valve means.

8. The printing press according to claim 4, wherein:

said cylindrical body defines a longitudinal axis, and said cylindrical body comprises:

a one-piece integral member comprising both said first connecting passage, and said second connecting passage, said at least one solid element comprises said one-piece integral member;

said first means for operating comprises means for rotating said cylindrical body within said bore; and said means for varying an amount of air flowing through said first air passage substantially independently of air flowing through said second air passage comprises second means for operating, said second means for operating comprises means for axially displacing said cylindrical body to move said first connecting passage relative to said first and second openings to vary an opening amount of said first air passage.

9. The printing press according to claim 8, wherein:

said first and second connecting passages are each disposed substantially diametrically through said cylindrical body and said first and second connecting passages are disposed spaced apart axially along said cylindrical body;

said first and second openings are disposed substantially diametrically with respect to one another on said housing;

said third and fourth openings are disposed substantially diametrically with respect to one another on said housing;

said first means for operating comprises a motor, said motor having a rotatable shaft, and said rotatable shaft additionally comprising a transmission for transmitting rotational movement to said first body portion; and said second means for operating comprises a pneumatic cylinder.

10. The printing press according to claim 9, wherein:

said third and fourth openings comprise oblong slots, the oblong slots having a longitudinal dimension, and the longitudinal dimension being disposed parallel to the longitudinal axis of said housing, said oblong slots being configured for maintaining said second air passage substantially open during axial movement of said cylindrical body to adjust air flow through said first air passage;

said pneumatic cylinder comprises a piston rod extending therefrom, said pneumatic cylinder and said piston rod defining a longitudinal axis;

said longitudinal axis of said pneumatic cylinder being disposed in alignment with said longitudinal axis of said cylindrical body;

said piston rod having a first end disposed away from said pneumatic cylinder;

said first end of said piston rod comprises means for engaging said cylindrical body for moving said cylindrical body during moving of said pneumatic cylinder;

said first means for operating further comprises a potentiometer driven by said rotatable shaft of said motor for measuring rotational movement of said motor;

said printing press further comprises at least one remote control panel for operating said first and second means for operating and monitoring said potentiometer;

said rotatable shaft further comprising a handwheel for manually turning said rotatable shaft;

said transmission comprises a first gear disposed on said rotatable shaft, and a second gear disposed on said first body portion, said second gear meshing with said first gear;

said second gear being non-rotatably connected to said cylindrical body for moving said first body portion during moving of said second gear;

said means for inputting air additionally comprises an air bypass for bypassing air around said valve means when said first air passage is closed; and said air bypass comprises an additional valve means for adjusting an amount of air bypassing said valve means.

11. In a printing press comprising:

a free, a plate cylinder rotatably mounted on said frame, said plate cylinder for positioning a printing plate thereon, dampening means for applying dampening medium to said printing plate, an ink reservoir for holding a supply of ink, an inking mechanism for transferring the ink between said ink reservoir and said plate cylinder at least during operation of said printing press, said inking mechanism comprising a plurality of inking rollers, at least one ink fountain roller, and at least one ink transfer roller for transferring ink between said ink fountain roller and at least one of said plurality of inking rollers, sheet feeding means for feeding sheets of printing stock into the printing press from a stack of printing stock, the stack having a top for supplying sheets therefrom, a rubber blanket cylinder having a rubber blanket disposed thereabout for receiving an ink impression from the plate cylinder, a sheet drum for receiving sheets being fed for printing the ink impression of the rubber blanket onto the sheets, and sheet delivery apparatus for receiving printed sheets and stacking the printed sheets;

means for controlling air flow of the sheet feeding means, the sheet feeding means having means for providing input air thereinto and means for removal of exhaust air therefrom, said means for controlling comprising:

valve means for controlling air flow through said means for providing input air and said means for removal of exhaust air;

said valve means comprising:

a first valve portion for controlling flow of air through said means for providing input air, said first valve portion having at least an open configuration for passage of air therethrough and a closed configuration for blocking passage of air therethrough;

a second valve portion for controlling flow of air through said means for removal of exhaust air, said second valve portion having at least an open configuration for passage of air therethrough and a closed configuration for passage of air therethrough;

at least one solid element connecting at least a portion of said first valve portion to at least a portion of said second valve portion for substantially simultaneously moving both of said at least a portion of said first valve portion and said at least a portion of said second valve portion between at least the open configuration and the closed configuration;

single operating means for operating all of said at least a portion of said first valve portion, said at least a portion of said second valve portion and said at least one solid element substantially simultaneously to substantially simultaneously open both said first and second valve portion and substantially simultaneously close said first and second valve portion; and means for operating said first valve portion substantially independently of said second valve portion for varying an amount of air flowing through said first valve portion substantially independently of the amount of air flowing through said second valve portion.

12. The means for controlling according to claim 11, wherein said valve means comprises:

a valve housing having first and second openings for defining a first air passage of said means for providing input air, and third and fourth openings for defining a second air passage of said means for removal of exhaust air;

a valve body for being disposed in said valve housing, said valve body comprising a first connecting passage for connecting said first and second openings, and a second connecting passage for connecting said third and fourth openings;

said first valve portion comprises said first and second openings and said first connecting passage;

said second valve portion comprises said third and fourth openings and said second connecting passage;

said single operating means being for moving said valve body within said valve housing to:

move said first connecting passage into at least partial alignment with said first and second openings to at least partially open said first air passage, and to substantially simultaneously move said second connecting passage into at least partial alignment with said third and fourth openings to at least partially open said second air passage; and move said first connecting passage substantially out of alignment with said first and second openings to at least substantially close said first air passage, and to substantially simultaneously move said second connecting passage substantially out of alignment with said third and fourth openings to at least substantially close said second air passage.

13. The means for controlling according to claim 12, wherein:

said valve housing has an exterior and defines a longitudinal axis;

said valve housing comprises a bore along said longitudinal axis;

said first, second, third and fourth openings being disposed through said housing from said exterior to said bore;

said valve body comprises a cylindrical body for being movably disposed within said bore;

said first and second connecting passages respectively comprise first and second bores within said cylindrical body; and said means for operating comprises means for moving said cylindrical body within said bore to at least partially open and at least substantially close said first and second air passages.

14. The means for controlling according to claim 13, wherein:

said means for operating comprises first means for operating, and said first means for operating comprises one of:

means for rotating said cylindrical body within said bore; and means for axially displacing said cylindrical body along the longitudinal axis of said bore.

15. The means for controlling according to claim 14, wherein:

said cylindrical body defines a longitudinal axis, and said cylindrical body comprises:

a first body portion comprising said first connecting passage;

a second body portion comprising said second connecting passage, said first body portion being axially disposed with respect to said second body portion along said longitudinal axis of said cylindrical body;

said at least one solid element comprises means for rotatably connecting said first body portion to said second body portion for relative rotational movement between said first body portion and said second body portion;

said first means for operating comprises means for axially displacing said cylindrical body within said bore;

said valve means further comprises means for inhibiting rotation of said second body portion; and said means for operating said first valve portion substantially independently of said second valve portion for varying an amount of air flowing through said first air passage substantially independently of air flowing through said second air passage comprises second means for operating, said second means for operating comprises means for rotating said first body portion relative to said second body portion to move said first connecting passage relative to said first and second openings to vary an opening amount of said first air passage.

16. The means for controlling according to claim 15, wherein:

said valve means further comprise means for axially positioning said cylindrical body with respect to said first means for operating to partially open said first air passage with said second air passage closed;

said first and second connecting passages are each disposed substantially diametrically through said cylindrical body;

said first and second openings are disposed substantially diametrically with respect to one another on said housing;

said third and fourth openings are disposed substantially diametrically with respect to one another on said housing;

said means for rotatably connecting comprises bolt means extending from one of said first body portion and said second body portion end a threaded opening on the other of said first body portion and said second body portion to receive said bolt means therein;

said means for inhibiting rotation comprises pin means extending from one of said housing and said second body portion and slot means in the other of said housing and said second body portion for receiving said pin means therein;

said first means for, operating comprises a pneumatic cylinder; and said second means for operating comprises a motor, said motor having a rotatable shaft, and said rotatable shaft additionally comprising a transmission for transmitting rotational movement to said first body portion.

17. The means for controlling according to claim 16, wherein:

said pneumatic cylinder comprises a piston rod extending therefrom, said pneumatic cylinder and said piston rod defining a longitudinal axis;

said longitudinal axis of said pneumatic cylinder being disposed in alignment with said longitudinal axis of said cylindrical body;

said piston rod having a first end disposed away from said pneumatic cylinder;

said second body portion comprises a threaded member extending therefrom towards said pneumatic cylinder;

said first end of said piston rod comprises a threaded nut for engaging said threaded member of said second body portion for moving said second body portion during moving of said pneumatic cylinder;

said means for axially positioning said cylindrical body with respect to said first means for operating comprises said threaded nut and said threaded member, whereby rotation of said threaded nut axially displaces said threaded member;

said second means for operating further comprises a potentiometer driven by said rotatable shaft of said motor for measuring rotational movement of said motor;

said rotatable shaft further comprising a handwheel for manually turning said rotatable shaft;

said transmission comprising a first gear disposed on said rotatable shaft, and a second gear disposed on said first body portion and meshing with said first gear;

said second gear being non-rotatably connected to said first body portion for movement of said first body portion with movement of said second gear; and said means for inputting air additionally comprises an air bypass for bypassing air around said valve means when said first air passage is closed; and said air bypass comprises an additional valve means for adjusting an amount of air bypassing said valve means.

18. The means for controlling according to claim 14, wherein:

said cylindrical body defines a longitudinal axis, and said cylindrical body comprises:

a one-piece integral member comprising both said first connecting passage, and said second connecting passage, said at least one solid element comprises said one-piece integral member;

said first means for operating comprises means for rotating said cylindrical body within said bore; and said means for operating said first valve portion substantially independently of said second valve portion for varying an amount of air flowing through said first air passage substantially independently of air flowing through said second air passage comprises second means for operating, said second means for operating comprises means for axially displacing said cylindrical body to move said first connecting passage relative to said first and second openings to vary an opening amount of said first air passage.

19. The means for controlling according to claim 18, wherein:

said first and second connecting passages are each disposed substantially diametrically through said cylindrical body and said first and second connecting passages are disposed spaced apart axially along said cylindrical body;

said first and second openings are disposed substantially diametrically with respect to one another on said housing;

said third and fourth openings are disposed substantially diametrically with respect to one another on said housing;

said first means for operating comprises a motor, said motor having a rotatable shaft, and said rotatable shaft additionally comprising a transmission for transmitting rotational movement to said first body portion; and said second means for operating comprises a pneumatic cylinder.

20. The means for controlling according to claim 19, wherein:

said third and fourth openings comprise oblong slots, the oblong slots having a longitudinal dimension, and the longitudinal dimension being disposed parallel to the longitudinal axis of said housing, said oblong slots being configured for maintaining said second air passage substantially open during axial movement of said cylindrical body to adjust air flow through said first air passage;

said pneumatic cylinder comprises a piston rod extending therefrom, said pneumatic cylinder and said piston rod defining a longitudinal axis;

said longitudinal axis of said pneumatic cylinder being disposed in alignment with said longitudinal axis of said cylindrical body;

said piston rod having a first end disposed away from said pneumatic cylinder;

said first end of said piston rod comprises means for engaging said cylindrical body for moving said cylindrical body during moving of said pneumatic cylinder;

said first means for operating further comprises a potentiometer driven by said rotatable shaft of said motor for measuring rotational movement of said motor;

said printing press further comprises et least one remote control panel for operating said first and second means for operating and monitoring said potentiometer;

said rotatable shaft further comprising a handwheel for manually turning said rotatable shaft;

said transmission comprises a first gear disposed on said rotatable shaft, and a second gear disposed on said first body portion, said second gear meshing with said first gear;

said second gear being non-rotatably connected to said cylindrical body for moving said first body portion during moving of said second gear;

said means for inputting air additionally comprises an air bypass for bypassing air around said valve means when said first air passage is closed; and said air bypass comprises an additional valve means for adjusting an amount of air bypassing said valve means.

* * * * *

UNITED STATES PATENT AND TRADEMARK OFFICE

CERTIFICATE OF CORRECTION

PATENT NO. : 5,476,041

DATED : December 19, 1995

INVENTOR(S) : Ernst CZOTSCHER

It is certified that error appears in the above-indentified patent and that said Letters Patent is hereby corrected as shown below:

On title page, item, [75], under the Inventor section, delete "NeckargemUnd" and insert --Neckargemünd--.

In column 1, line 29, after 'No.' delete "5,068,876" and insert --5,058,876--.

In column 2, line 10, after 'off' delete "end" and insert --and--.

In column 3, line 53, after 'element' delete "Substantially" and insert --substantially--.

In column 3, line 67, after 'in' delete "en" and insert --an--.

In column 5, line 1, after 'body' delete "i" and insert --1--.

In column 7, line 62, before 'entitled' delete "Feeset" and insert --Faeser--.

UNITED STATES PATENT AND TRADEMARK OFFICE

CERTIFICATE OF CORRECTION

PATENT NO. : 5,476,041

DATED : December 19, 1995

INVENTOR(S) : Ernst CZOTSCHER

It is certified that error appears in the above-indentified patent and that said Letters Patent is hereby corrected as shown below:

In column 8, line 11, after 'to' delete "Seaski" and insert --Sasaki--.

In column 8, line 12, after 'to' delete "Schwitmky" and insert --Schwitzky--.

In column 9, line 8, Claim 1, after 'cylinder' delete "i".

In column 10, line 34, Claim 3, after 'has' delete "an;exterior" and insert --an exterior--.

In column 12, line 11, Claim 7, after 'rotational' delete "movement/of" and insert --movement of--.

In column 13, line 38, Claim 11, after the first occurrence of 'a' delete "free" and insert --frame--.

In column 18, line 22, Claim 20, after 'comprises' delete "et" and insert --at--.

Signed and Sealed this

Thirteenth Day of August, 1996

*Attest:*

*Attesting Officer*

Bruce Lehman

BRUCE LEHMAN

*Commissioner of Patents and Trademarks*